US005345636A

United States Patent [19]

Lamons

[11] Patent Number: 5,345,636

[45] Date of Patent: Sep. 13, 1994

[54] MULTI-TOOL ADJUSTABLE WRENCH

[76] Inventor: Danny E. Lamons, 706 River Canyon Rd., Chattanooga, Tenn. 37405

[21] Appl. No.: 10,580

[22] Filed: Jan. 28, 1993

[51] Int. Cl.[5] ..... B25F 1/00

[52] U.S. Cl. ..... 7/139; 7/143; 7/164; 7/165; 7/107

[58] Field of Search ..... 7/139, 138, 143, 107, 7/164, 165

[56] References Cited

U.S. PATENT DOCUMENTS

| | | | |
|---|---|---|---|
| 1,562,018 | 11/1925 | Warff | 7/164 |
| 2,528,128 | 10/1950 | Forster | 7/143 |
| 4,234,987 | 11/1980 | Charette | 7/143 |
| 4,326,436 | 4/1982 | McGraw | 81/165 |
| 5,237,715 | 8/1993 | Bane | 7/139 |
| 5,245,721 | 9/1993 | Lowe et al. | 7/165 |
| 5,251,352 | 10/1993 | Cullison | 7/165 |

FOREIGN PATENT DOCUMENTS

| | | | |
|---|---|---|---|
| 1089098 | 3/1955 | France | 7/107 |

*Primary Examiner*—Roscoe V. Parker
*Attorney, Agent, or Firm*—Miller & Martil

[57] ABSTRACT

A multi-tool adjustable wrench which provides for the adaption of an adjustable wrench so that it may be used as a hammer and a wrench, without the hammer surface interfering with the wrench's utility and without exposing the adjustment mechanism to severe damage. The hammer surface is located on the wrench head rearward of the adjusting mechanism. In addition, the wrench handle is adapted to function as a screwdriver, measuring ruler, wire stripper, and T-handle. The handle and base of the wrench head form a square face. Inch and metric measuring scales are provided on the wrench jaws with auxiliary Vernier scales for accurate measurement.

10 Claims, 2 Drawing Sheets

MULTI-TOOL ADJUSTABLE WRENCH

BACKGROUND OF THE INVENTION

This invention relates to the adaption of an adjustable wrench to permit it to be used as a hammer, screwdriver, ruler and caliper, wire stripper, "T" handle, square face, and adjustable square.

In many mechanical occupations, adjustable wrenches are among the principal tools utilized. Adjustable wrenches allow a mechanic to work on a piece of machinery with only one wrench rather than a complete wrench set. The nature of many mechanical tasks is such that it is necessary to hammer on the machinery to either fit a piece into place or to dislodge a piece of the machinery, and for many years mechanics have used the heads of their adjustable wrenches as hammers to avoid the necessity of carrying an additional tool. Frequently, other tools such as screwdrivers or measuring instruments are also needed and it would be a great convenience for mechanics if all these tools were combined into one implement.

Other attempts to manufacture combination tools based upon an adjustable wrench have been made and, in particular, U.S. Pat. No. 4,234,987, pointed out that the structure of the head of an adjustable wrench is not well suited for use as a hammer head. This is primarily because the screw adjustment passage that is formed in the head opens through the crown portion of the head, which portion is most conveniently located for use as a hammer face. The solution adopted in U.S. Pat. No. 4,234,987 involves the addition of a hammer head on the crown portion of the wrench head. Although this structure protects the screw adjustment passage, it also adds mass and a significant protrusion from the wrench head, thereby making it impossible to utilize the wrench in some close fitting situations.

SUMMARY OF THE INVENTION

It is the primary object of this invention to provide an adaption of an adjustable wrench so that it may be used alternately as a hammer and as a wrench without the use as a hammer exposing the wrench mechanism to severe damage, and without the addition of substantial protrusions to the wrench.

It is a further object of this invention to incorporate a caliper and a ruler into an adjustable wrench so that the wrench may be used for taking measurements.

It is yet another object of the invention to incorporate a square face into an adjustable wrench.

It is yet a further object of the invention to incorporate a "T" handle into the handle of an adjustable wrench.

It is yet another object of the invention to incorporate an adjustable square or angle measuring device into an adjustable wrench.

It is yet another object of the invention to incorporate a screwdriver and a wire stripper into an adjustable wrench.

BRIEF DESCRIPTIONS OF THE DRAWINGS

DESCRIPTION OF THE PREFERRED EMBODIMENTS

Figure 1:
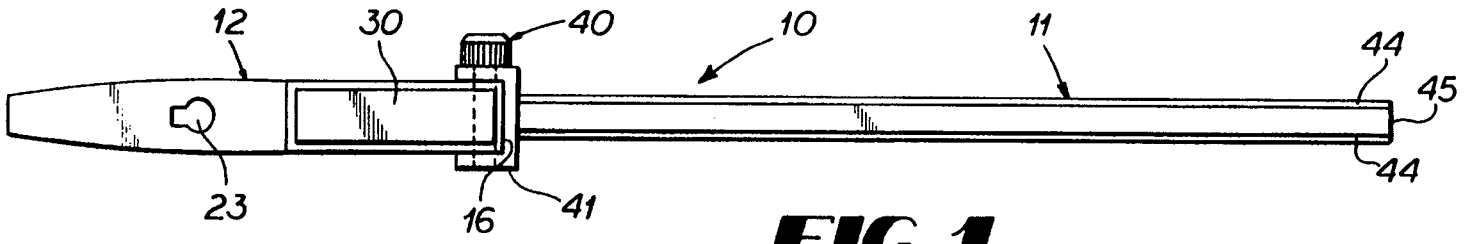
FIG. 1 is a top plan view of an embodiment of the invention incorporating an adjustable square.

In FIG. 1, an embodiment of the improved adjustable wrench 10 is illustrated with a wrench head 12 and handle 11. Also shown is the hammer face 30 located toward the base 16 of the wrench head 12. An opening 23 is shown at the crown 14 (illustrated in FIG. 2) of the wrench head, said opening 23 providing access to part of the adjusting mechanism described below. A further feature of the illustrated wrench 10 is the thumb screw 40, which may be loosened to allow the projecting shoe 41 to move across the handle 11 in arcuate fashion. Also shown are the top edge 45 and the tapered edges 44 of the handle 11 so that the shape of the handle is more easily grippable.

Figure 2:
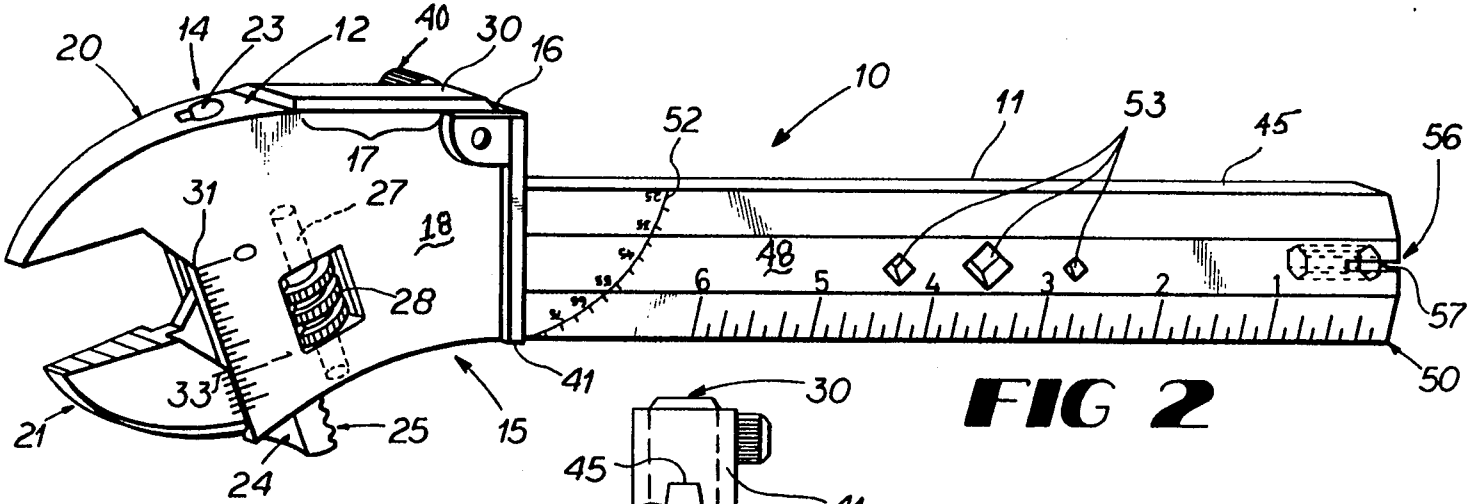
FIG. 2 is a front perspective view of an embodiment of the invention incorporating an adjustable square.

Turning now to FIG. 2, an adjustable wrench 10 with wrench head 12 and handle 11 is illustrated. The wrench head 12 has an upper fixed jaw 20 and a lower movable jaw 21 disposed opposite one another. The wrench head 12 also contains an adjustment channel (not illustrated) which passes from the opening 23 in the crown 14 of the fixed jaw through to the neck 15 of the wrench. The moveable jaw 21 has a leg portion 24 with a rack face 25 mounted in the adjustment channel. In FIG. 2, the leg portion 24 and rack face 25 are protruding from the opening of the adjustment channel on the neck 15 of the wrench. An adjusting screw 28 is supported on a rotatable shaft 27 mounted in the wrench head adjacent to the adjustment channel (not illustrated). The thread of said screw 28 meshes with the rack face 25 of the leg portion 24 of the moveable jaw 21. Rotation of the adjusting screw 28 slidably moves the leg portion 24 in the adjustment channel and, accordingly, adjusts the distance between the fixed jaw 20 and moveable jaw 21 so that the wrench may be used with nuts of various sizes.

As a further modification, the front 18 of the wrench head 12 has an index line 31 marked in inches and the back 19 of the wrench head 12 (shown in FIG. 5) has an index line 32 marked in centimeters or millimeters. The use of axillary Vernier scales 33 (shown in FIG. 2) and 34 (shown in FIG. 5) on the moveable jaw 21 allows these indexes to be read with greater accuracy than previous indexed wrenches, such as that illustrated in U.S. Pat. No. 4,326,436.

Still referring to FIG. 2, the contour of the front 18 of the wrench head 12 proceeding from the fixed jaw 20 back to the handle 11 does not taper substantially from the crown 14 toward the base 16 as in most prior art wrenches, but rather maintains substantial width from the crown 14 to the base 16 of the wrench head. The top edge 17 of the portion from the crown 14 to the base 16 of the wrench head 12 is substantially planar and within approximately 15° of parallel to the top 45 of the wrench handle 11. A hammer face 30 is mounted on this planar edge portion 17 of the wrench head 12. The hammer face 30 should also be substantially planar and within approximately 15° of parallel to the top 45 of the wrench handle 11. In this way the hammer face 30 is properly positioned for ease of use.

The hammer face 30 is usually made of hardened steel, but may be composed of a variety of materials depending upon the desired use of the wrench as a hammering tool. If the wrench will be used for tapping more delicate machinery, a resilient plastic or urethane surface may be desired. For more precise work, a brass surface may be preferred. The plastic or brass surfaces may be mounted on the planar edge portion by the use of screws, a slotted joint or other conventional means, not shown.

Figure 5:
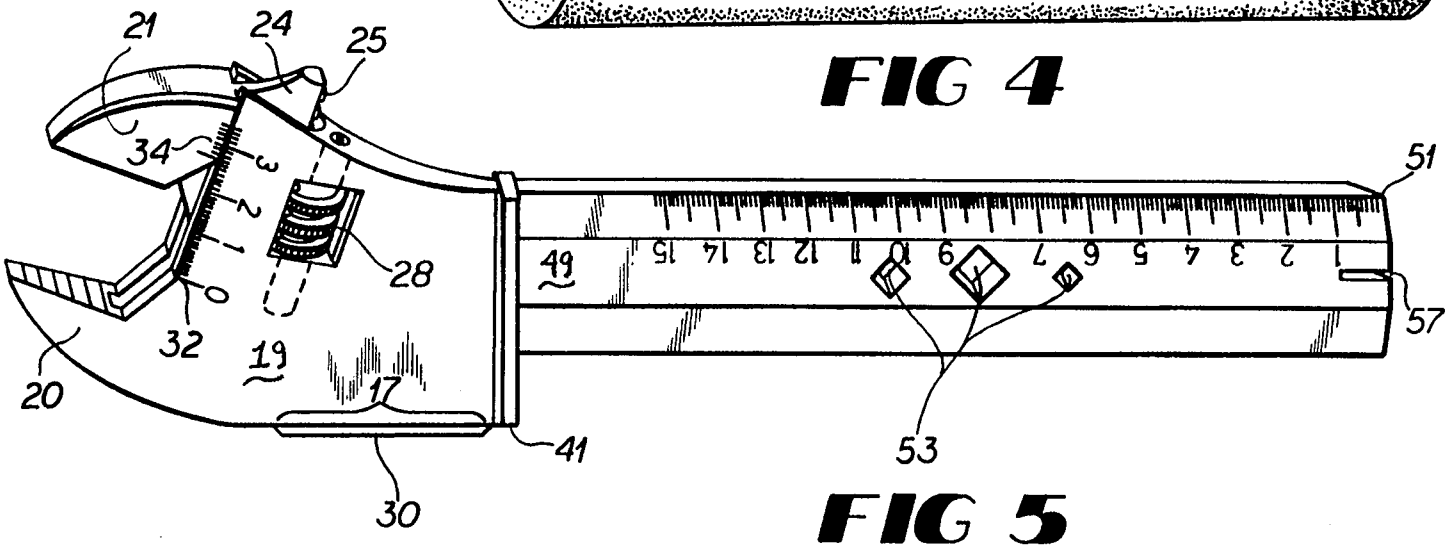
FIG. 5 is a back perspective view of an embodiment of the invention without an adjustable square.

Also shown in FIG. 2 and FIG. 5 at the base 16 of the wrench head 12 is a rectangular shoe 41 which is set at a right angle to the handle 11. In this manner the shoe 41 and handle 11 form a square face.

In the embodiment shown in FIG. 2, the projecting shoe 41 may be mounted to the base 16 of the wrench head by a thumb screw 40 which when loosened allows the shoe 41 to arcuately pass across the handle 11. An index line 52 for angular measurement is placed on the handle and in this fashion a variable square or protractor is created.

FIG. 2 shows that the front 48 of the handle 11 has an index line 50 calibrated in inches and FIG. 5 shows that the back 49 of the handle 11 has an index line 51 calibrated in centimeters and millimeters so that the adjustable wrench 10 may be used for measuring. In addition, the handle 11 is depicted with three square apertures 53. These apertures 53 are sized to accept standard shank sizes for threading taps. In this fashion, the adjusting wrench 10 may be used as a "T" handle for taps to cut threads.

Figure 3:
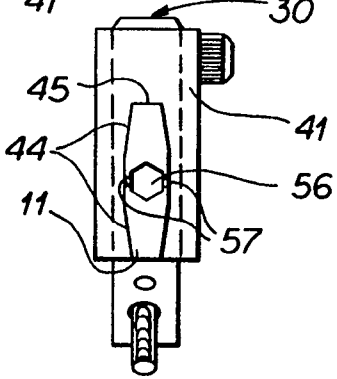
FIG. 3 is a right elevation plan view of an embodiment of the invention.

In FIG. 3, the handle 11 is also fixed with a hexagonal opening 56 in the base. This hexagonal opening 56 is adapted to accept a screwdriver head, not shown, preferably reversible between Phillips and standard heads. Also shown are slots or notches 57 connecting the hexagonal opening to the front 48 and back 49 of the handle. The slots 57 are added to facilitate manufacture and also are sized to serve as a wire stripping tool when the screwdriver head is removed.

Figure 4:
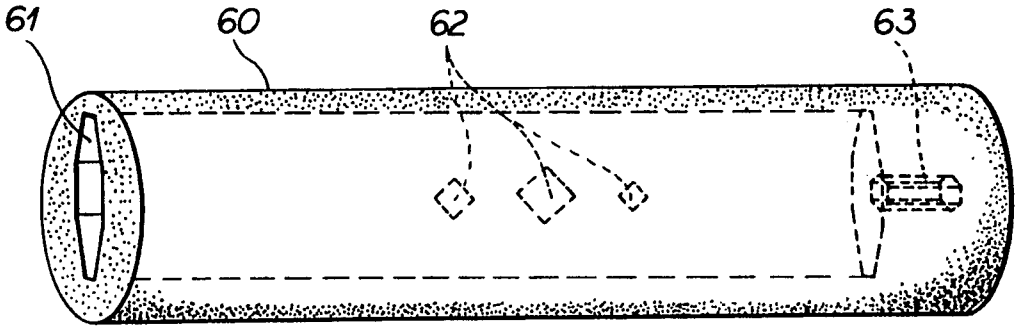
FIG. 4 is a front perspective view of an insulated grip adapted for use with the invention.

Turning now to FIG. 4, an optional grip 60 is shown with an opening 61 to accept the handle 11. Flexible male protrusions 62 are positioned to lock in the apertures 53 of the handle. In addition, the grip has a cavity 63 to permit the handle to be inserted with the screwdriver head in place. The grip 60 is preferably made of a resilient insulating material and may be formed with contours for more comfortable grasping.

Figure 6:
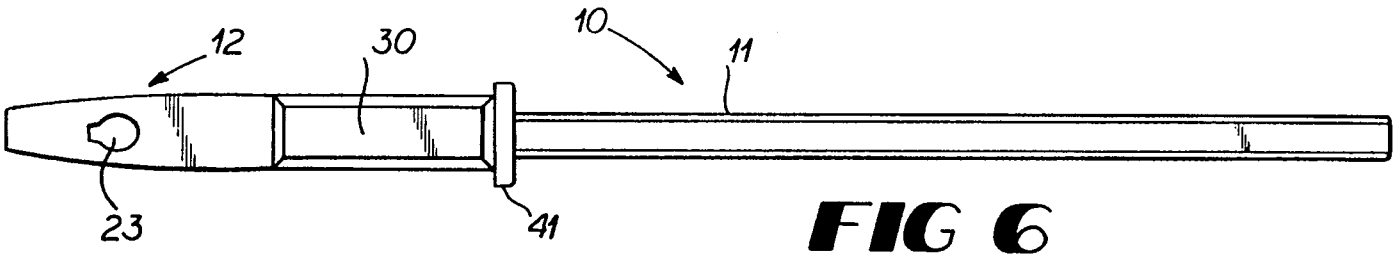
FIG. 6 is a top plan view of an embodiment of the invention without an adjustable square.

FIG. 6 is a top plan view of an alternate embodiment of the invention without the adjustable square face feature.

Numerous alterations of the structure herein described will suggest themselves to those skilled in the art. It will be understood that the details and arrangements of the parts which have been described and illustrated in order to explain the nature of the invention are not to be construed as any limitation of the invention. All such alterations which do not depart from the spirit of the invention are intended to be included within the scope of the appended claims.

I claim:

1. A wrench comprising:

(a) a wrench head having a fixed first jaw, a crown and a base wherein said wrench head is provided with a first major surface with an inch measuring scale for indicating the distance between the first and second jaws, and said wrench head is provided with an opposed second major surface with a metric measuring scale for indicating the distance between the first and second jaws;

(b) a second jaw slideably mounted in the wrench head wherein said second jaw is provided with a first major surface with an auxiliary Vernier scale to allow more accurate reading of the distance between the first and second jaws, and said second jaw is provided with an opposed second major surface with an auxiliary Vernier scale to allow more accurate reading of the distance between the first and second jaws;

(c) an adjusting means for varying the distance between said first jaw and said second jaw;

(d) a hammer face positioned between the crown and the base of the wrench head; and (e) a handle with a proximate end mounted to the base of the wrench head, and an opposite distal end.

2. A wrench comprising:

(a) a wrench head having a fixed first jaw, a crown and a base;

(b) a second jaw slideably mounted in the wrench head;

(c) an adjusting means for varying the distance between said first jaw and said second jaw;

(d) a hammer face positioned between the crown and the base of the wrench head; and (e) a handle with a proximate end mounted to the base of the wrench head, and an opposite distal end, wherein the base of the wrench head is substantially planar and the handle has at least one straight edge perpendicular to the base of the wrench head.

3. A wrench according to claim 2 wherein:

wherein the proximate end of the handle is provided with a first major surface having an angle measuring scale; and the base of the wrench head has a projecting shoe which can be moved arcuately across the angle measuring scale.

4. A wrench comprising:

(a) a wrench head having a fixed first jaw, a crown, a top edge and a base;

(b) a second jaw slideably mounted in the wrench head;

(c) an adjusting means for varying the distance between said first jaw and said second jaw;

(d) a hammer face positioned between the crown and the base of the wrench head wherein the hammer face is substantially flush with the top edge of the wrench head; and (e) a handle with a proximate end mounted to the base of the wrench head, and an opposite distal end.

5. A wrench according to claim 4 wherein said wrench head is provided with a first major surface with an inch measuring scale for indicating the distance between the first and second jaws; and said wrench head is provided with an opposed second major surface with a metric measuring scale for indicating the distance between the first and second jaws.

6. A wrench according to claim 4 wherein the handle is provided with a first major surface with an inch measuring scale; and the handle is provided with an opposed second major surface with a metric measuring scale.

7. A wrench according to claim 4 wherein the handle contains at least one square aperature.

8. A wrench according to claim 4 wherein the handle has a peripheral notch adapted to stripping insulation from wire.

9. A wrench according to claim 4 further comprising an insulating grip having an opening conforming substantially to the shape of the handle, and permitting the handle to be inserted into said opening and frictionally secured therein.

10. A wrench according to claim 4 wherein the distal end of the handle further comprises a screwdriver.

* * * * *